US011903489B1

(12) United States Patent
Zhong

(10) Patent No.: US 11,903,489 B1
(45) Date of Patent: Feb. 20, 2024

(54) INFLATABLE BED WITH MATTRESS

(71) Applicant: Wuzhou Baofeng Plastic Products Co., Ltd., Wuzhou (CN)

(72) Inventor: Bo Zhong, Wuzhou (CN)

(73) Assignee: Wuzhou Baofeng Plastic Products Co., Ltd., Wuzhou (CN)

( * ) Notice: Subject to any disclaimer, the term of this patent is extended or adjusted under 35 U.S.C. 154(b) by 0 days.

(21) Appl. No.: 18/385,440

(22) Filed: Oct. 31, 2023

(30) Foreign Application Priority Data

Nov. 4, 2022 (CN) ..... 202222944572.8

(51) Int. Cl.
*A47C 27/08* (2006.01)
*A47C 27/00* (2006.01)

(52) U.S. Cl.
CPC ..... *A47C 27/082* (2013.01); *A47C 27/087* (2013.01); *A47C 27/088* (2013.01); *A47C 27/081* (2013.01)

(58) Field of Classification Search
CPC ..... A47C 27/082; A47C 27/087; A47C 27/088; A47C 27/081; A47C 27/08
USPC ..... 5/706, 709, 655.3, 654, 644
See application file for complete search history.

(56) References Cited

U.S. PATENT DOCUMENTS 4,955,095 A * 9/1990 Gerrick ..... A47C 31/105 5/691
5,109,559 A * 5/1992 West ..... A47C 27/085 5/691
5,136,741 A * 8/1992 Balonick ..... A47C 27/15 5/699
5,398,354 A * 3/1995 Balonick ..... A47C 27/20 5/922
5,530,978 A * 7/1996 Johenning ..... A47C 27/085 5/669
7,849,541 B2 * 12/2010 Gauger ..... A47C 27/081 5/678
2009/0193580 A1 * 8/2009 Gauger ..... A47C 19/021 5/678
2014/0096325 A1 * 4/2014 Giannopoulos ..... A47C 27/00 5/691

* cited by examiner

*Primary Examiner* — Robert G Santos
(74) *Attorney, Agent, or Firm* — COOPER LEGAL GROUP, LLC

(57) ABSTRACT

An inflatable bed with mattress includes a bed body including a top panel, a bottom panel and a first side panel, whose top is connected to the edge of the top panel while whose bottom is connected to the edge of the bottom panel, all three enclose a gas chamber, a connecting side panel extends vertically from the top of the first side panel, and a mattress including a first cloth adhesion layer, a sponge layer and a second cloth adhesion layer, a second side panel is arranged around the sponge layer, the top of the second side panel is connected to the peripheral edge of the first cloth adhesion layer, the bottom of the second side panel is connected to the peripheral edge of the second cloth adhesion layer, and the top of the connecting side panel is connected to the peripheral edge of the first cloth adhesion layer.

13 Claims, 8 Drawing Sheets

INFLATABLE BED WITH MATTRESS

CROSS-REFERENCE TO RELATED APPLICATION

The present application claims priority to Chinese Patent Application No. 202222944572.8, filed on Nov. 4, 2022, and entitled "inflatable bed with mattress". The contents of Chinese Patent Application No. 202222944572.8 are incorporated herein by reference in their entirety as a part of the present application.

TECHNICAL FIELD

The present application relates to the field of furniture, in particular to an inflatable bed with mattress.

BACKGROUND ART

At present, with improved quality of life, more and more people are fond of outdoor camping, picnic and other outdoor activities. Inflatable beds are often taken along and used in outdoor camping or camping activities, which is rolled up and folded after exhausting by daily storage, to save storage space and thus be portable. When in use, the bed body of the inflatable bed is inflated with gas, so that the volume is increased to support the human body evenly with air buoyancy.

The inflatable bed is characterized in small volume and light weight. The volume in uninflated state is about the same as that of an ordinary bed sheet. It can be folded and be portable, can be inflated with gas and placed indoors and outdoors, so that it gets rid of the bulky defects of traditional mattress furniture. In addition to being used for outdoor camping, it can also be used for entertaining guests at home, taking a nap in the office, etc. It has a wide range of applications.

At present, the bed body of the inflatable bed is generally formed be means of welding waterproof cloth. The surface of the bed body after inflation expands under the action of expanding gas and becomes harder as a result of being stretched, so that the waterproof cloth on the surface of the inflated bed body feels hard, thereby having low comfort.

SUMMARY

In order to solve the problem that the surface of the inflated bed body feels hard, an inflatable bed with mattress is disclosed.

An inflatable bed with mattress disclosed adopts the following technical solution:

An inflatable bed with mattress, comprising a bed body and a mattress on a top of the bed body, wherein the bed body comprises a top panel, a bottom panel and a first side panel, a top of the first side panel is connected to an edge of the top panel, a bottom of the first side panel is connected to an edge of the bottom panel, the top panel, the bottom panel and the first side panel are enclosed to form a gas chamber, a connecting side panel extends vertically from the top of the first side panel, the mattress comprises a first cloth adhesion layer, a sponge layer and a second cloth adhesion layer in sequence from top to bottom, a second side panel is arranged around the sponge layer, a top of the second side panel is connected to a peripheral edge of the first cloth adhesion layer, a bottom of the second side panel is connected to a peripheral edge of the second cloth adhesion layer, and a top of the connecting side panel is connected to the peripheral edge of the first cloth adhesion layer.

According to the above technical solution, the top panel, the bottom panel and the first side panel are enclosed to form a gas chamber for accommodating gas. After the gas enters the gas chamber, the bed body is expanded and forms an inflatable bed structure. The first cloth adhesion layer, the sponge layer and the second cloth adhesion layer form the mattress with a sandwich structure, and the mattress possesses a stable structure in the following way, that the second side panel is fused with the first cloth adhesion layer and the second cloth adhesion layer. On the other hand, the connecting side panel extending vertically from the top of the first side panel encloses an accommodating groove together with the top panel. The mattress is placed in the accommodating groove. Then the first cloth adhesion layer of the mattress is fused with the top of the connecting side panel to integrally connect the mattress to the bed body. Preferably, the first side panel and the connecting side panel are an integral sheet, so that the connecting side panel connected to the mattress and the bed body part can be integral, thereby improving the stability of the integral connection between the mattress and the bed body.

When the inflatable bed is fully inflated, the mattress containing the sponge layer can improve the soft and comfort use feeling of the inflatable bed. When the inflatable bed is not in use, the bed body can be wound around the mattress to facilitate storage of the entire inflatable bed with mattress, reaching high practicality.

Optionally, the connecting side panel is configured with a plurality of exhaust holes.

Since the second cloth adhesion layer of the mattress is not directly connected to the top panel of the bed body, an interspace is formed therebetween. By the plurality of exhaust holes on the connecting side panel, in addition to inflating and expanding the bed body when being used, external gas can also enter the interspace between the second cloth adhesion layer and the top panel through the exhaust holes, so that surplus air is present between the bottom of the mattress and the top of the bed body, and thus the mattress forms a relative suspension structure. When the human body lies on the mattress, the air between the bottom of the mattress and the top of the bed body is discharged through the exhaust holes. That is to say, when the human body sits or lies on the mattress, the mattress is deformed in a buffering way, which improves the comfort use feeling.

When the inflatable bed with mattress is not in use, after the gas in the bed body is discharged, the bed body is rolled up along with the winding of the mattress. The gas between the bottom of the mattress and the top of the mattress can also be exhausted through the exhaust holes, thereby reducing residual gas between the bottom of the mattress and the top of the mattress, which results in inconvenient winding and storage, thus possessing a high practicality.

Optionally, a length of a section where the plurality of exhaust holes are located does not exceed ⅗ of a length of a corresponding side of the connecting side panel where the plurality of exhaust holes are located, and a height of the section where the plurality of exhaust holes are located does not exceed ⅗ of a height of the corresponding side of the connecting side panel where the plurality of exhaust holes are located.

According to the above technical solution, the gas can enter into the space between the bottom of the mattress and the top of the mattress through the exhaust holes, or the gas can be discharged from the space between the bottom of the mattress and the top of the mattress under pressure. The practicality is high.

Optionally, the sponge layer is configured with a plurality of first channels along a length direction of the sponge layer.

Optionally, the sponge layer is configured with a plurality of second channels along a width direction of the sponge layer.

According to the above technical solution, sponges can be saved and thus it is cost-effective. The sponge waste generated by configuring the channel can be recycled and reused. The configured channel provides a displacement space for the sponge, so that part of the sponge of the sponge layer can move into the channel when the mattress is rolled up. The volume of the rolled-up mattress is smaller, more convenient to carry, thereby saving storage space.

Optionally, two ends of each of the plurality of first channels pass through two respective sides of the sponge layer.

According to the above technical solution, when the human body sits or lies on the mattress, a concave and convex support structure along the length direction or width direction of the mattress is formed on it, which improves the support force and tactility, thus being comfortable in use.

Optionally, seals are provided at two ends of each of the plurality of channels, and an outside of each of the seals is flush with a respective sidewall of the sponge layer.

According to the above technical solution, the channel is configured as a blind hole. When the human body sits or lies on the mattress, the gas in the channel is slowly discharged outward through the micropores of the sponge layer, and the seals enhance the supporting force on the edge zone of the sponge layer, so that the edge zone will not be depressed due to the open end of the channel when being used.

Optionally, one side of the second side panel is configured with a vent, and the connecting side panel is configured with a gas nozzle communicated with the vent.

According to the above technical solution, the gas nozzle is in communication with the vent. The mattress can be inflated by way of self-inflation through the gas nozzle or can be inflated by means of an external gas pumping device through the gas nozzle. The inflated gas can circulate through the micropores and channel structure of the sponge layer and thus expand and support the sponge layer. The amount of gas in the mattress is increased, which improves the supporting force and soft and comfort use feeling of the mattress. When the inflatable bed is not in use, the internal gas of the mattress can be discharged by squeezing the mattress in the direction of the gas nozzle or by the following way, that gas is sucked through the gas nozzle by means of an external gas pumping device, thereby reducing the volume of the mattress. After the gas is exhausted through the gas nozzle of the bed body or be means of the external gas pumping device, the bed body can be rolled up around the mattress to facilitate storage of the entire inflatable bed with mattress. The practicality is high.

Optionally, the first cloth adhesion layer includes a first cloth layer and a first adhesion layer adhered to a lower surface of the first cloth layer, the second cloth adhesion layer includes a second cloth layer and a second adhesion layer adhered to an upper surface of the second cloth layer, a lower surface of the first adhesion layer is adhered to an upper surface of the sponge layer, and an upper surface of the second adhesion layer is adhered to a lower surface of the sponge layer.

According to the above technical solution, the first cloth layer, the first adhesion layer, the sponge layer, the second adhesion layer and the second cloth layer can be stably bonded in sequence, so that the mattress possesses a compact structure, which reduces the risk that the first adhesion layer or the second adhesion layer expands excessively due to the inflated gas when the mattress is inflated, which in turn results in the damage to the laminar structure of the mattress caused by the easy detachment of the first adhesion layer or the second adhesion layer from the sponge layer. Moreover, the first adhesion layer and the second adhesion layer with adhesive properties are hydrophobic and waterproof, and thus a waterproof property and gas tightness on the top and bottom surface of the mattress layer can be achieved, so that the gas inflated in the sponge layer is not easy to permeate the first adhesion layer or the second adhesion layer, thereby reducing the separation between layers of the mattress layer due to excessive expansion.

Optionally, the first adhesion layer is a TPU film layer or a PVC film layer, and the second adhesion layer is a TPU film layer or a PVC film layer.

According to the above technical solution, the TPU film layer or PVC film layer can be stably bonded to the cloth layer and the sponge layer, so that the adhesion between the layers of the obtained mattress is stable and the separation between layers is less likely to occur. At the same time, the TPU film layer or PVC film layer is waterproof to a certain extent, which makes it difficult for external moisture to permeate the sponge layer through the first cloth adhesion layer when being used. The service life is extended.

In summary, at least one of the following beneficial technical effects is realized.

1. The top panel, the bottom panel and the first side panel are enclosed to form a gas chamber for accommodating gas. The first cloth adhesion layer, the sponge layer and the second cloth adhesion layer form the mattress with a sandwich structure, and the mattress possesses a stable structure in the following way, that the second side panel is fused with the first cloth adhesion layer and the second cloth adhesion layer. And the mattress is placed in the accommodating groove formed by the connecting side panel together with the top panel. Then the first cloth adhesion layer of the mattress is fused with the top of the connecting side panel to integrally connect the mattress to the bed body, thereby improving the stability and softness of the inflatable bed, which has a comfortable use.
2. By configuring the plurality of exhaust holes, external gas can enter the interspace between the second cloth adhesion layer and the top panel through the exhaust holes, so that surplus gas is present between the bottom of the mattress and the top of the bed body, and thus the mattress forms a relative suspension structure. At the same time, when the inflatable bed should be rolled up, the bed body is rolled up around the mattress after the bed body is exhausted and folded. The gas between the bottom of the mattress and the top of the bed body is discharged outward through the exhaust holes, which is convenient for tightly winding the inflatable bed, thereby realizing storage and carrying. The practicality is high.

DETAILED DESCRIPTION

The present application will be described in further detail below with reference to accompanying drawings 1-8.

The embodiments of the present application disclose an inflatable bed with mattress.

Embodiment 1

Figure 1:
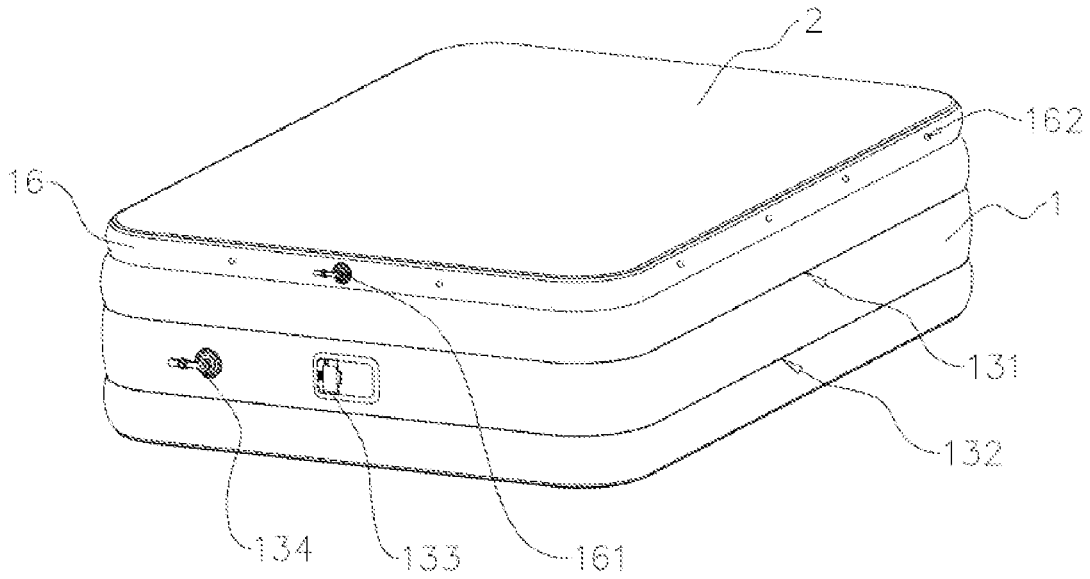
FIG. 1 is a schematic view showing the structure of the inflatable bed with mattress according to the embodiment 1 of the present application.
Figure 2:
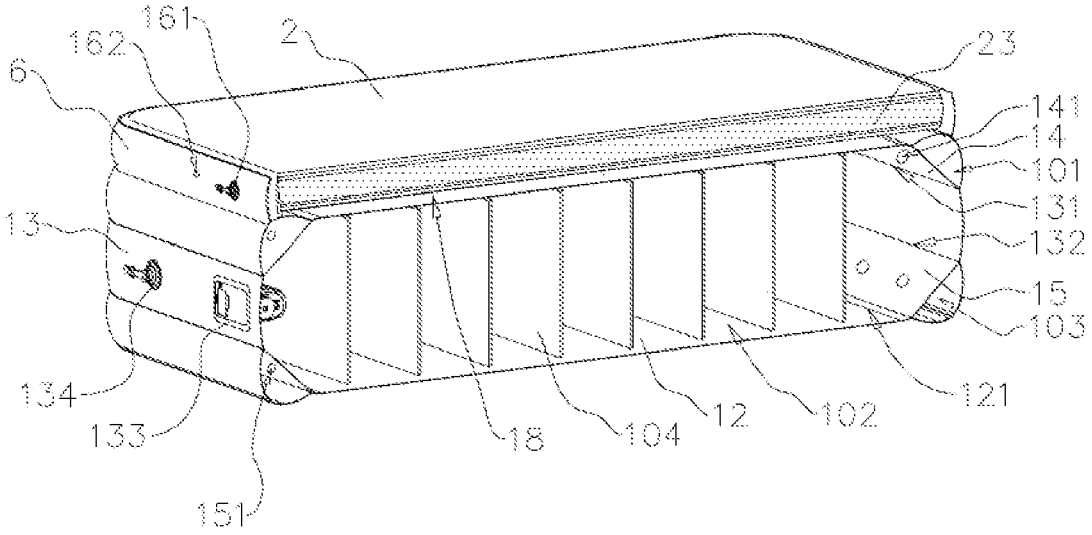
FIG. 2 is a partial sectional view of the inflatable bed with mattress according to the embodiment 1 of the present application.

Referring to FIG. 1 and FIG. 2, an inflatable bed with mattress includes a bed body 1 and a mattress 2. The bed body 1 includes a top panel 11, a bottom panel 12 and a first side panel 13. The top of the first side panel 13 is connected to the edge of the top panel 11. The bottom of the first side panel 13 is connected to the edge of the bottom panel 12. The top panel 11, the bottom panel 12 and the first side panel 13 are enclosed to form a gas chamber. Preferably, a first connecting diaphragm 14 and a second connecting diaphragm 15 are symmetrically arranged in the bed body 1. The first connecting diaphragm 14 is inclined from top to bottom. The top of the first connecting diaphragm 14 is connected to the top panel 11 and forms a first connecting strip 111 at the joint with the top panel 11. The bottom of the first connecting diaphragm 14 is connected to the first side panel 13 close to the top panel 11 and forms a second connecting strip 131 at the joint with the first side panel 13. The second connecting diaphragm 15 is inclined from top to bottom. Specifically, the top of the second connecting diaphragm 15 is connected to the first side panel 13 close to the bottom panel 12 and forms a third connecting strip 132 at the joint with the first side panel 13, the bottom of the second connecting diaphragm 15 is connected to the bottom panel 12 and forms a fourth connecting strip 121 at the joint with the bottom panel 12.

The top of the first connecting diaphragm 14 is pulled toward the middle thereof along the first connecting strip 111, and the bottom of the first connecting diaphragm 14 is pulled toward the middle thereof along the second connecting strip 131, so that the first connecting diaphragm 14 together with the section close to the edge of the top panel 11 and the section close to the top of the first side panel 13 are enclosed to form a first gas chamber 101. The top panel 11, the first connecting diaphragm 14, the second connecting diaphragm 15, the bottom panel 12 and the first side panels 13 are enclosed to form a second gas chamber 102. The third connecting strip 132 pulls the first side panel 13 toward the middle of the second connecting diaphragm 15, and the fourth connecting strip 121 pulls the bottom panel 12 toward the middle of the second connecting diaphragm 15, so that the second connecting diaphragm 15 together with the section close to the edge of the bottom panel 12 and the section close to the bottom of the first side panel 13 are enclosed to form a third gas chamber 103.

Preferably, the first connecting diaphragm 14 can be configured with a plurality of first ventilation holes 141, the second connecting diaphragm 15 can be configured with a plurality of second ventilation holes 151. The first side panel 13 is configured with an inflating and deflating port 134 for the second gas chamber 102. An external gas pumping device is connected to the inflating and deflating port 134 to fill the second gas chamber 102 with gas. Or optionally, the first side panel 13 is configured with a gas pump 133 and an inflating and deflating port 134 for the second gas chamber 102. That is, the gas pump 133 is optionally provided on the first side panel 13 (can be provided or not). If the gas pump 133 is provided, gas can be pumped into the second gas chamber 102 through the gas pump 133, wherein the second gas chamber 102 is in communication with the first gas chamber 101 through the first ventilation hole 141, and is in communication with the third gas chamber 103 through the second ventilation hole 151, so that the first gas chamber 101, the second gas chamber 102 and the third gas chamber 103 are all in communication with each other, to realize the internal air circulation in the bed body 1, and to ensure the uniform inflation and deflation of the bed body 1.

Referring back to FIG. 2, drawstrings 104 are also provided in the bed body 1. The top of the drawstring 104 is connected to the inner surface of the top panel 11, and the bottom of the drawstring 104 is connected to the inner surface of the bottom panel 12, so that the top panel 11 can be steadily connected with the bottom panel 12 in the inflated state of the inflatable bed. Preferably, the drawstring 104 is made of a flexible material, so that the inflatable bed can be easily deformed and folded by deflation and storage. The drawstring 104 can be rope-shaped, sheet-shaped, or be a doughnut-shaped strip, all of which are within the protection scope of the present application. Only the sheet-shaped drawstring 104 is shown in FIG. 2. When the drawstring 104 is rope-shaped, the first end of the rope-shaped drawstring 104 is connected to the inner surface of the top panel 11, and the second end of the rope-shaped drawstring 104 is connected to the inner surface of the bottom panel 12. When the drawstring 104 is a doughnut-shaped strip, the long rope-shaped drawstring 104 can be symmetrically folded, whose two ends are connected with each other to form a doughnut-shaped structure, wherein the folded rope-shaped structure at the first end of the drawstring 104 can be connected to the inner surface of the top panel 11 directly or by means of a component such as a connector, and the folded rope-shaped structure at the second end of the drawstring 104 can be connected to the inner surface of the bottom panel 12 directly or by means of a component such as a connector.

Figure 3:
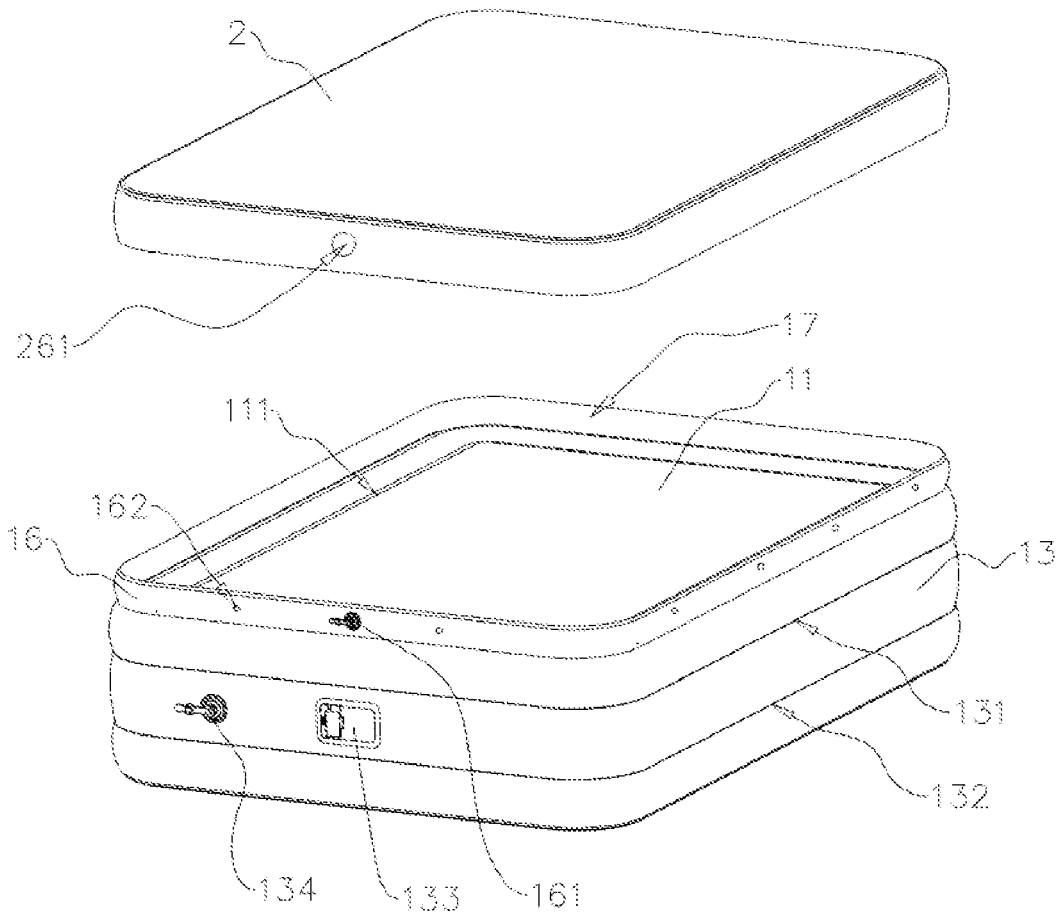
FIG. 3 is an explosive view showing the structure of the inflatable bed with mattress according to the embodiment 1 of the present application.
Figure 4:
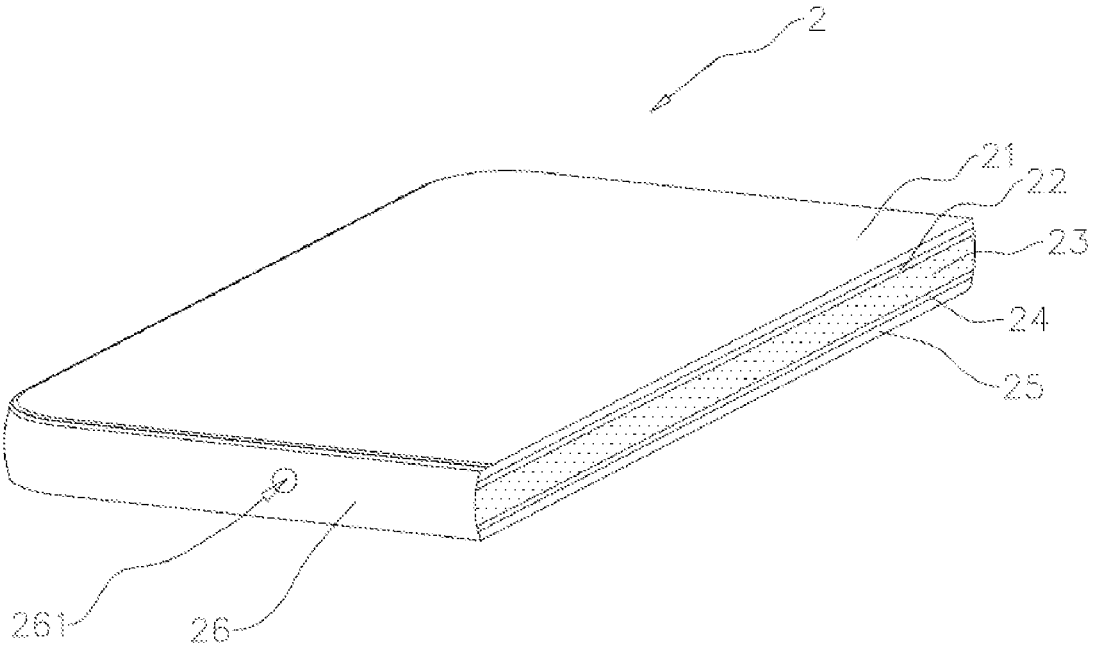
FIG. 4 is a partial sectional view of the mattress according to the embodiment 1 of the present application.
Figure 5:
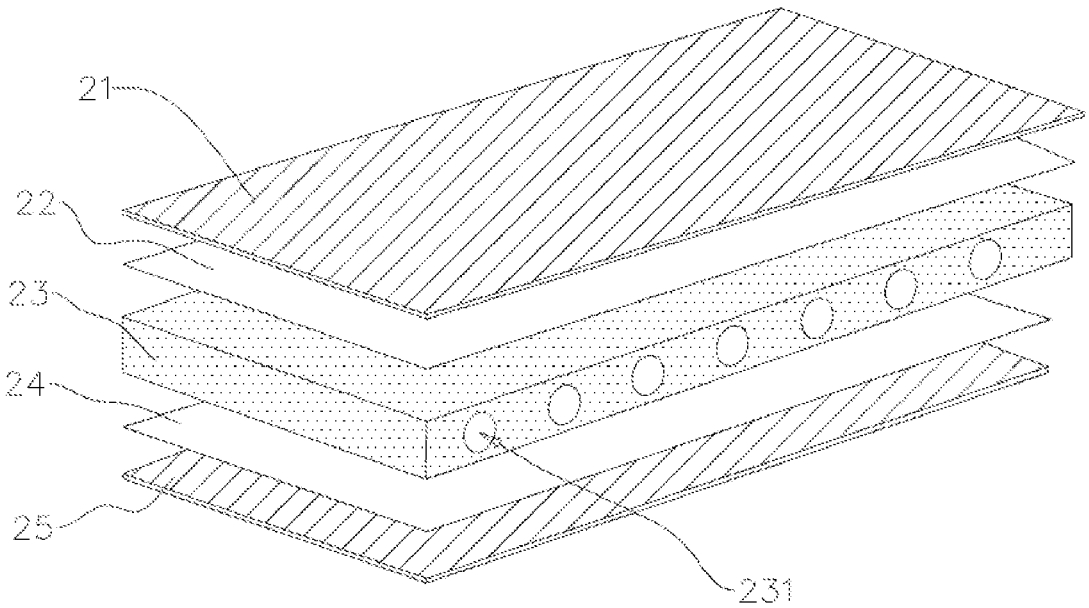
FIG. 5 is an explosive view showing the structure of the mattress according to the embodiment 1 of the present application.
Figure 6:
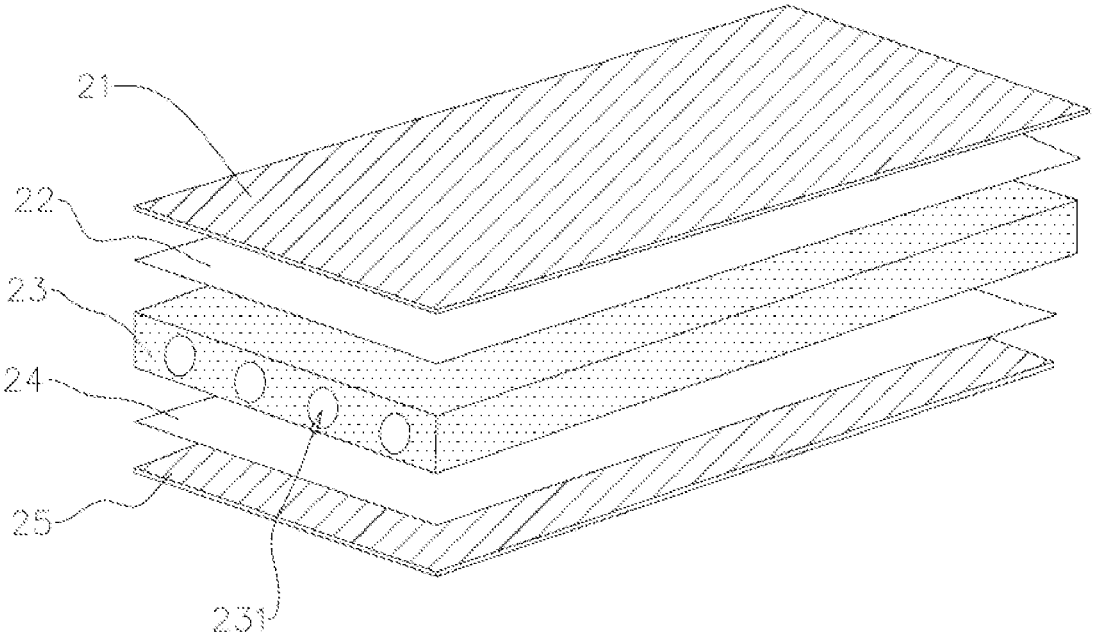
FIG. 6 is another explosive view showing the structure of the mattress according to the embodiment 1 of the present application.

Referring to FIG. 3 and FIG. 4, the mattress 2 includes a first cloth layer 21, a first adhesion layer 22, a sponge layer 23, a second adhesion layer 24 and a second cloth layer 25 connected in sequence from top to bottom. Referring to FIG. 5 and FIG. 6, the sponge layer 23 is configured with a plurality of channels 231 at intervals along its length direction or width direction. A second side panel 26 is arranged around the periphery of the sponge layer 23. The top of the second side panel 26 is fused to the peripheral edge of the first cloth adhesion layer, and the bottom of the second side panel 26 is fused to the peripheral edge of the second cloth adhesion layer, so as to form a compact mattress 2. One side of the second side panel 26 is configured with a vent 261 communicated with the interior. Preferably, the first adhesion layer 22 and the second adhesion layer 24 both are TPU film layers or PVC film layers. The longitudinal cross-section of the channel 231 can be circular, elliptical, diamond-shaped, rectangular, pentagonal, hexagonal and other polygon-shaped, which, regardless of shape, are all within the protection scope of this application.

Further, Referring back to FIG. 3 and FIG. 4, a connecting side panel 16 extends vertically upwards from the joint between the first side panel 13 and the top panel 11. The connecting side panel 16 and the first side panel 13 are made of a same one sheet material. At the same time, the connecting side panel of the bed body 1 and the top panel 11 are enclosed to form an accommodating groove 17. The entire structure of the mattress 2 is accommodated in the accommodating groove 17. At the same time, the peripheral edge of the first cloth adhesion layer of the mattress 2 are fused to the peripheral edge at the top of the connecting side panel 16, so that the mattress 2 and the bed body 1 are stably connected, to obtain an inflatable bed with mattress with a stable structure. In addition, an interspace 18 is formed between the bottom of the second cloth adhesion layer of the mattress 2 and the top of the top panel 11 of the bed body 1. At the same time, the connecting side panel 16 is configured with a gas nozzle 161 and a plurality of exhaust holes 162. The gas nozzle 161 is in communication with the vent 261 of the second side panel 26. The length of the section where the exhaust holes 162 are located does not exceed ⅗ of the length of the corresponding side of the connecting side panel where the exhaust holes are located, and the height of the section where the exhaust holes 162 are located does not exceed ⅗ of the height of the corresponding side of the connecting side panel where the exhaust holes are located, so that the outside world is in communication with the interspace 18 through the exhaust holes 162. The shape of the exhaust hole 162 can be circular, elliptical, diamond-shaped, rectangular, pentagonal, hexagonal and other polygon-shaped, which, regardless of shape, are all within the scope of protection of this application.

The external gas enters the interspace 18 through the exhaust holes 162 when used, which realizes a suspension effect of the mattress 2, thereby feeling comfortable. When the inflatable bed shall be stored, the gas in the bed body 1 is exhausted, meanwhile, the bed body 1 is wound around the mattress 2, thereby realizing winding and storage, which is convenient for storage or carrying. The vent 261 of the second side panel 26 is in communication with the gas nozzle 161 of the connecting side panel 16. The external gas pumping device is in communication with the vent 261 and the gas nozzle 161 through a gas pumping pipe, so that the gas pumping device can inflate and deflate the sponge of the mattress 2 through the vent 261 and the gas nozzle 161, so as to quickly expand the compressed and wound sponge layer 23, which is convenient to use or exhaust gas, thereby reducing the volume of the mattress 2 and facilitating the storage.

In this embodiment, the top panel 11, the bottom panel 12, the first side panel 13 and the connecting side panel 16 can all be made of PVC material or TPU material, or can all be adhesive cloth formed by adhesion of cloth and TPU film layer or PVC film layer (that is, they have the same composition structure as the first cloth adhesion layer and the second cloth adhesion layer), which are all within the protection scope of this application. When a film layer is provided on the inner surface of the cloth, the fusion stability between two clothes can be improved. For example, the peripheral edge of the top panel 11 is fused to the inner surface at the top of the first side panel 13 at the inner surface of the top panel 11 through the TPU film layer or the PVC film layer. When the top panel 11, the bottom panel 12, the first side panel 13, and the connecting side panel 16 are all made of PVC material or TPU material, two sheets are directly fused, for example, the peripheral edge of the top panel 11 is directly fused to the peripheral edge at the top of the first side panel 13.

The implementation principle of the embodiment 1 is as follows. The peripheral edge of the top panel 11 is fused to the top of the first side panel 13, while the peripheral edge of the bottom panel 12 is fused to the bottom of the first side panel 13. The top of the first connecting diaphragm 14 is fused to the inner surface close to the edge of the top panel 11 to form a first connecting strip 111, while the bottom of the first connecting diaphragm 14 is fused to the inner surface close to the edge of the top of the first side panel 13 to form a second connecting strip 131. The top of the second connecting diaphragm 15 is fused to the inner surface of the first side panel 13 close to the edge of the bottom to form a third connecting strip 132, while the bottom of the second connecting diaphragm 15 is fused to the inner surface of the bottom panel 12 close to the edge thereof to form a fourth connecting strip 121. Therefore, a first gas chamber 101, a second gas chamber 102 and a third gas chamber 103 are formed in turn. At the same time, the connecting side panel 16 extending from the top of the first side panel 13 and the top panel 11 are enclosed to form an accommodating groove 17, so as to obtain the bed body 1.

The first cloth layer 21, the first adhesion layer 22, the sponge layer 23, the second adhesion layer 24 and the second cloth layer 25 are laminated and adhered in sequence, wherein the top of the second side panel 26 is fused to the peripheral edge of the first cloth layer 21, the bottom of the second side panel 26 is fused to the peripheral edge of the second cloth adhesion layer, meanwhile, the offcut after fusion of the bottom of the second side panel 26 and the peripheral edge of the second cloth adhesion layer is removed. The mattress 2 is obtained.

The mattress 2 is then placed in the accommodating groove 17. The fusion joint between the top of the second side panel 26 and the peripheral edges of the first cloth adhesion layer is fused again to the top of the connecting side panel 16 to connect the mattress 2 to the bed body 1, meanwhile, the offcut is removed. The inflatable bed with mattress is obtained.

When the inflatable bed with mattress is used, it is connected to the components such as an external gas pumping device through the inflating and deflating port 134 to inflate the second gas chamber 102 of the bed body 1. If the first side panel 13 is provided with a gas pump 133, then the second gas chamber 102 of the bed body 1 can be inflated through the gas pump 133 or the external gas pumping device and other components; and a gas circulation in the first gas chamber 101, in the second gas chamber 102 and the third gas chamber 103 can be realized through the first ventilation holes 141 and the second ventilation holes 151, to fill the bed body 1 with gas. At the same time, the external gas pumping device can be used to communicate with the vent 261 and the gas nozzle 161, to inflate the sponge layer 23, so that the mattress 2 is filled with gas. The inflatable bed with mattress can then be used.

When not in use, the gas in the bed body 1 and the mattress 2 is exhausted. An assembly such as an external inflating and deflating device can be used to communicate with the inflating and deflating port 134, so as to suck the gas out of the bed body 1 to achieve an evacuation state. Alternatively, the air in the bed body 1 can be exhausted by way of self-deflation of the inflating and deflating port 134. Similarly, an assembly such as an external inflating and deflating device can be used to communicate with the gas nozzle 161 to suck the gas out of the mattress 2 to achieve an evacuation state. Alternatively, the mattress 2 is squeezed by being rolled up, so that the gas in the mattress 2 is exhausted through the gas nozzle 161. The bed body 1 is rolled up along with the winding of the mattress 2, which is convenient for storage or carrying.

Embodiment 2

Figure 7:
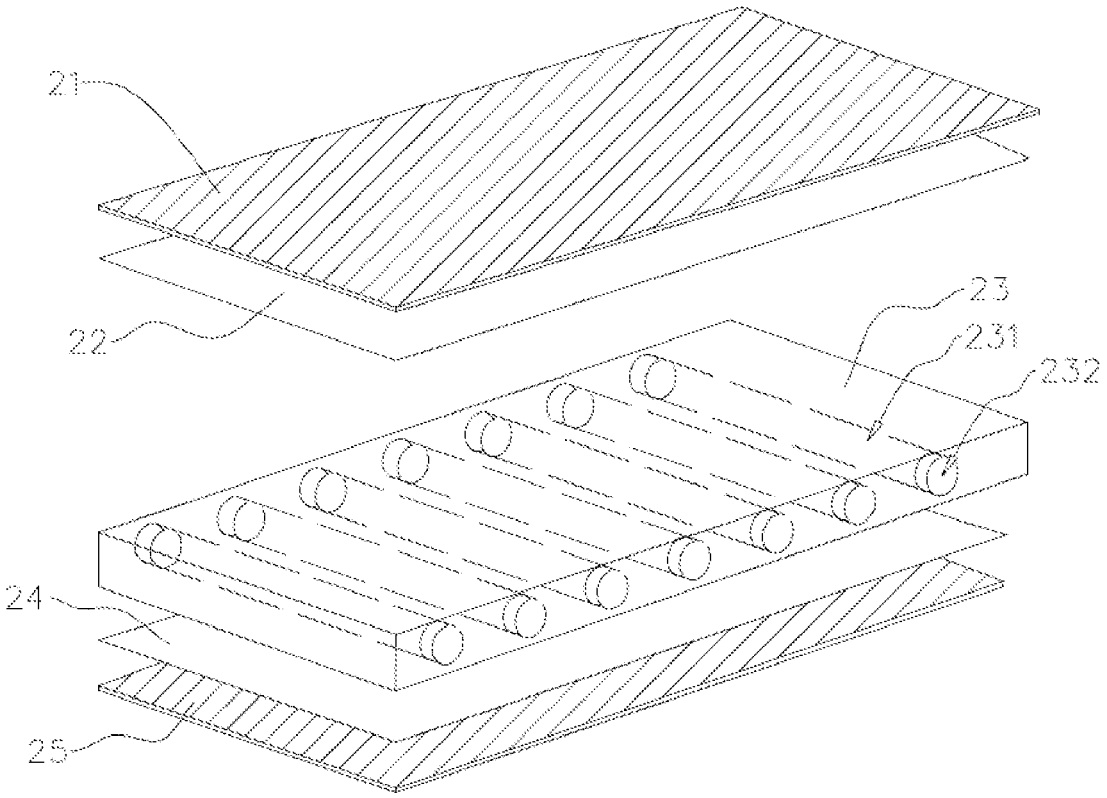
FIG. 7 is an explosive view showing the structure of the mattress according to the embodiment 2 of the present application.
Figure 8:
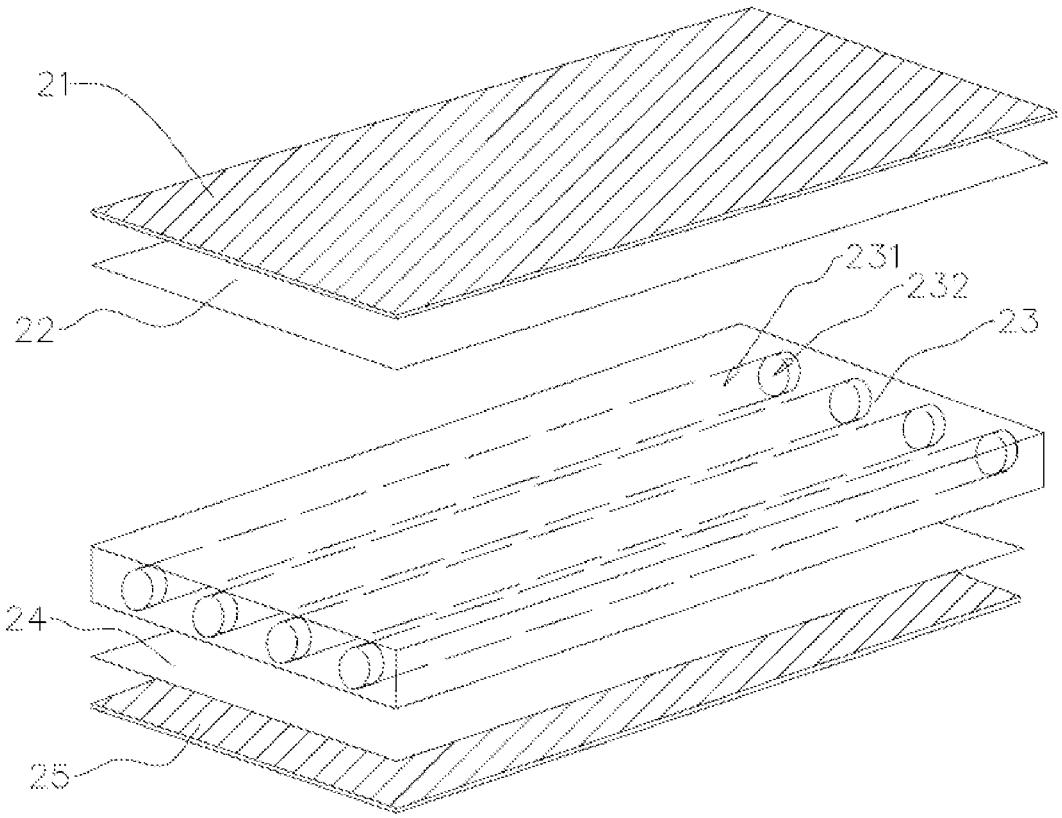
FIG. 8 is another explosive view showing the structure of the mattress according to the embodiment 2 of the present application.

Referring to FIG. 7 and FIG. 8, the difference between this embodiment and the above-mentioned embodiment 1 is that seals 232 are provided at two ends of the channel 231 in the sponge layer 23. The outside of the seal 232 is flush with the respective sidewall of the sponge layer 23, so that the channel 231 has a blind hole structure. Other structural features are the same as those in embodiment 1 and will not be repeated here.

All of the above are preferred embodiments of the present application, and are not intended to limit the protection scope of the application. Therefore, all equivalent modification made according to the structure, shape and principle of the application should be covered by the protection scope of the application.

LIST OF REFERENCE SIGNS

1 bed body
11 top panel
111 first connecting strip
12 bottom panel
121 fourth connecting strip
13 first side panel
131 second connecting strip
132 third connecting strip
133 gas pump
134 inflating and deflating port
14 first connecting diaphragm
141 first ventilation hole
15 second connecting diaphragm
151 second ventilation hole
16 connecting side panel
161 gas nozzle
162 exhaust hole
17 accommodating groove
18 interspace
101 first gas chamber
102 second gas chamber
103 third gas chamber
104 drawstring
2 mattress
21 first cloth layer
22 first adhesion layer
23 sponge layer
231 channel
232 seal
24 second adhesion layer
25 second cloth layer
26 second side panel
261 vent

What is claimed is:

1. An inflatable bed with mattress, comprising a bed body and a mattress on a top of the bed body, wherein the bed body comprises a top panel, a bottom panel and a first side panel, a top of the first side panel is connected to an edge of the top panel, a bottom of the first side panel is connected to an edge of the bottom panel, the top panel, the bottom panel and the first side panel are enclosed to form a gas chamber, a connecting side panel extends vertically from the top of the first side panel, the mattress comprises a first cloth adhesion layer, a sponge layer and a second cloth adhesion layer in sequence from top to bottom, a second side panel is arranged around the sponge layer, a top of the second side panel is connected to a peripheral edge of the first cloth adhesion layer, a bottom of the second side panel is connected to a peripheral edge of the second cloth adhesion layer, and a top of the connecting side panel is connected to the peripheral edge of the first cloth adhesion layer.

2. The inflatable bed with mattress according to claim 1, wherein the connecting side panel is configured with a plurality of exhaust holes.

3. The inflatable bed with mattress according to claim 2, wherein a length of a section where the plurality of exhaust holes are located does not exceed ⅗ of a length of a corresponding side of the connecting side panel where the plurality of exhaust holes are located, and a height of the section where the plurality of exhaust holes are located does not exceed ⅗ of a height of the corresponding side of the connecting side panel where the plurality of exhaust holes are located.

4. The inflatable bed with mattress according to claim 1, wherein the sponge layer is configured with a plurality of first channels along a length direction of the sponge layer.

5. The inflatable bed with mattress according to claim 1, wherein the sponge layer is configured with a plurality of channels along a width direction of the sponge layer.

6. The inflatable bed with mattress according to claim 4, wherein two ends of each of the plurality of first channels pass through two respective sides of the sponge layer.

7. The inflatable bed with mattress according to claim 5, wherein two ends of each of the plurality of channels pass through two respective sides of the sponge layer.

8. The inflatable bed with mattress according to claim 4, wherein seals are provided at two ends of each of the plurality of first channels, and an outside of each of the seals is flush with a respective sidewall of the sponge layer.

9. The inflatable bed with mattress according to claim 5, wherein seals are provided at two ends of each of the plurality of channels, and an outside of each of the seals is flush with a respective sidewall of the sponge layer.

10. The inflatable bed with mattress according to claim 4, wherein one side of the second side panel is configured with a vent, and the connecting side panel is configured with a gas nozzle in communication with the vent.

11. The inflatable bed with mattress according to claim 5, wherein one side of the second side panel is configured with a vent, and the connecting side panel is configured with a gas nozzle in communication with the vent.

12. The inflatable bed with mattress according to claim 1, wherein the first cloth adhesion layer comprises a first cloth layer and a first adhesion layer adhered to a lower surface of the first cloth layer, the second cloth adhesion layer comprises a second cloth layer and a second adhesion layer adhered to an upper surface of the second cloth layer, a lower surface of the first adhesion layer is adhered to an upper surface of the sponge layer, and an upper surface of the second adhesion layer is adhered to a lower surface of the sponge layer.

13. The inflatable bed with mattress according to claim 12, wherein the first adhesion layer is a thermoplastic polyurethane (TPU) film layer or a polyvinyl chloride (PVC) film layer, and the second adhesion layer is a second TPU film layer or a second PVC film layer.

* * * * *